US005092049A

United States Patent [19]

Grubbs et al.

[11] Patent Number: 5,092,049

[45] Date of Patent: Mar. 3, 1992

[54] LEVER ACTUATED SCISSORS

[75] Inventors: Jeffrey W. Grubbs, Lynchburg, Va.; David S. Chapin, Raleigh, N.C.

[73] Assignee: Cooper Industries, Inc., Houston, Tex.

[21] Appl. No.: 426,314

[22] Filed: Oct. 24, 1989

Related U.S. Application Data

[63] Continuation-in-part of Ser. No. 282,235, Dec. 9, 1988, abandoned, and a continuation-in-part of Ser. No. 282,236, Dec. 9, 1988, Pat. No. 4,958,435.

[51] Int. Cl.[5] ..... B26B 13/00

[52] U.S. Cl. ..... 30/248; 30/249

[58] Field of Search ..... 30/248, 234, 235, 244, 30/252, 254, 257, 246, 250, 175, 349, 232, 231, 230

[56] References Cited

U.S. PATENT DOCUMENTS

| | | | |
|---|---|---|---|
| 2,662,285 | 12/1953 | Yeomans | 30/248 |
| 2,679,096 | 5/1954 | Wallace | 30/248 |
| 2,873,525 | 2/1959 | Wallace | 30/248 |
| 3,064,351 | 11/1962 | Kuchta et al. | 30/248 |
| 3,296,697 | 1/1967 | Hedstrom | 30/248 |
| 3,375,581 | 4/1968 | Knight | 30/248 |
| 3,438,130 | 4/1969 | Ballard et al. | 30/248 |
| 3,613,240 | 10/1971 | Wallace | 30/248 |
| 3,624,900 | 12/1971 | Bosley | 30/234 |
| 4,069,584 | 1/1978 | Germain | 30/248 |
| 4,507,864 | 4/1985 | Leibowitz | 30/257 |
| 4,958,435 | 9/1990 | Grubbs et al. | 30/234 |

*Primary Examiner*—Frank T. Yost
*Assistant Examiner*—Hwei-Siu Payer
*Attorney, Agent, or Firm*—David A. Rose

[57] ABSTRACT

Disclosed is a device for cutting cloth or the like, including a lower substantially fixed blade and an upper movable blade pivotal with respect to the fixed blade. A handle extends at an acute angle with respect to the fixed blade and substantially transverse to the pivot axis of the blades. A lever is pivotally disposed within the handle, and the lever contacts a cam attached to the movable blade such that pivoting the lever effects pivoting of the movable blade. A trigger mechanism is disposed in the handle and manipulation of the trigger mechanism effects pivoting of the lever, and thus the movable blade.

29 Claims, 3 Drawing Sheets

LEVER ACTUATED SCISSORS

RELATED APPLICATIONS

This application is a continuation-in-part of U.S. application Ser. Nos. 07/282,235 now abandoned, and 07/282,236, now U.S. Pat. No. 4,958,435 both filed on Dec. 9, 1988, the benefit of both applications being hereby claimed.

FIELD OF THE INVENTION

The present invention relates to scissors with pivotal blades, wherein a trigger mechanism which is disposed in a handle is adapted to sit on one side of the workpiece, and wherein actuation of the trigger mechanism effects pivoting of the scissor blades.

BACKGROUND OF THE INVENTION

Scissors having handles which lie on substantially the same axis as the cutting blades are well known. The disadvantage of such a design is that the operator's hand must be bent at the wrist during operation, which easily leads to fatigue. Modifications of this basic design have the handles at an obtuse angle with respect to the scissor blades in order to decrease the bend in the operator's wrist. Nevertheless, with either the basic or modified design, the handles must be pivoted with respect to each other to effect cutting. Moving the handles while cutting, particularly in the modified device where the scissor blades are at an angle with regard to the scissor blades, is difficult for the operator. Additionally, in order to support the scissor blades and provide a more even cut, it is preferable to place the material being cut on a flat surface. Moreover, with either design, the edge of the material being cut defines an axis which bisects the operator's hand. This makes it difficult to align the blades and maintain a straight cut.

There is, therefore, a need for scissors that do not require as great an effort to operate and which provide an even cut even without placing the material to be cut on a flat surface. Additionally, it would be more comfortable for the operator to have a device where, during cutting:

(i) the operator's hand can be located on one side of the material being cut rather than on either side of the edge of the material;

(ii) the operator's hand can extend straight out from the arm and not be bent down from the wrist; and (iii) the operator can continue a cut which has been started by merely pushing the device through the material without pivoting the handles or the blades.

Of the scissors known to Applicants, Seeberger, U.S. Pat. No. 2,326,178, discloses shears or scissors wherein a handle extends at an acute angle transverse to the pivot axis of the blades, and an actuating lever extends at a slightly more acute angle forwardly of the handle. The lever pivots with respect to the handle behind the pivot point of the blades. A forwardly extending portion of the lever is connected to an extension 7 which is part of a movable blade. The pivot point of the blades 2 is located at the front of the extension 7, forwardly of the pivot point of the actuating lever.

Branske, U.S. Pat. No. 2,776,535, discloses a lawn edger with an oscillating blade which is actuated by forcing an upright handle downwardly. An arm 43 is pivotally connected to a tightening screw 44 of a clamp 45, and the clamp is attached to the handle. The arm 43 is also pivotally attached to the upper blade. Thus, downward movement of the handle causes the arm 43 and the upper blade to also move down, which closes the blades.

West German Document No. 124,783 by Rudolph discloses shears having an upper blade which pivots with respect to the lower blade. A lever attaches the upper blade, at a point behind the pivot point, to the perimeter of a rotatable member. The rotatable member is designed to roll on a flat surface, and as it does so, moves the lever and causes oscillation of the upper blade.

Page, U.S. Pat. No. 2,376,002, discloses a cutter for sprouts or tree suckers. When the branch to be cut is placed between the blades, the cutter is hung downwardly. A handle 22 is pulled down, moving down a rod 20 which is attached to an extension from a movable blade 13. The extension from the movable blade 13 is positioned rearwardly from the pivot point of the movable blade. Thus, downward movement of the handle 22 causes pivoting of the movable blade.

None of the cutting devices known to Applicants disclose or suggest a trigger actuated scissor device with a handle which extends at an acute angle to the axis of the blades and transverse to the pivot axis of the blades, having a pivotal lever connecting the trigger and the movable blade, wherein the lever engages the movable blade at a point forwardly of the pivot point of the blades. A scissor device with such a configuration can have a lower axial dimension considerably less than that of the Seeberger device, and still provide enough leverage at the trigger so that the operator can pivot the upper blade and cut through thick or difficult to cut material.

Further, none of the known scissor devices disclose or suggest a trigger mechanism in a handle which is actuated by sliding the trigger substantially transversely to the axis of the handle. Such a mechanism is easy for the operator to manipulate.

SUMMARY OF THE INVENTION

The invention includes a scissor device in which the blades are pivoted by actuating a trigger on a handle by moving it transversely to the axis of the handle. The handle extends at an acute angle transverse to the pivot axis of the blades and is designed to sit on one side of the workpiece. A lever, which connects motion from the trigger to the upper blade, preferably engages a cam on the upper blade at a point forwardly of the pivot axis of the blades. Such a scissor device:

(i) allows the operator's hand to be located on one side of the material being cut;

(ii) allows the operator's hand to extend straight out from the wrist during operation;

(iii) allows a cut to be continued once started without pivoting of the blades; and (iv) allows a relatively short lower axial dimension, and still allows cutting through thick or difficult to cut material.

The scissor device has upper and lower blades which are pivotally attached to each other. A handle is preferably affixed to one of the blades at an acute angle with respect to the axis of the blades and transverse to the pivot axis of the blades. One end of a pivoting lever mechanism which is housed in the handle engages a cam on the movable blade which is preferably disposed forwardly from the pivot point of the blades. The other end of the lever mechanism contacts a trigger. Actuating the trigger pivots the lever, which in turn pivots the movable blade with respect to the fixed blade, causing the blades to close and cut. A spring may be positioned at the pivot point of the blades to return the blades to the open position.

If desired, a mechanical adjustment may be included to restrict the travel of the trigger mechanism, and thereby to restrict the degree to which the blades can close. With such an adjustment, the trigger can be depressed and yet the blades will still be kept slightly open allowing the device to cut by pushing it through the material without pivoting the blades.

The device will now be described with reference to the drawings and the preferred embodiments.

DETAILED DESCRIPTION OF THE PREFERRED EMBODIMENTS

Figure 1:
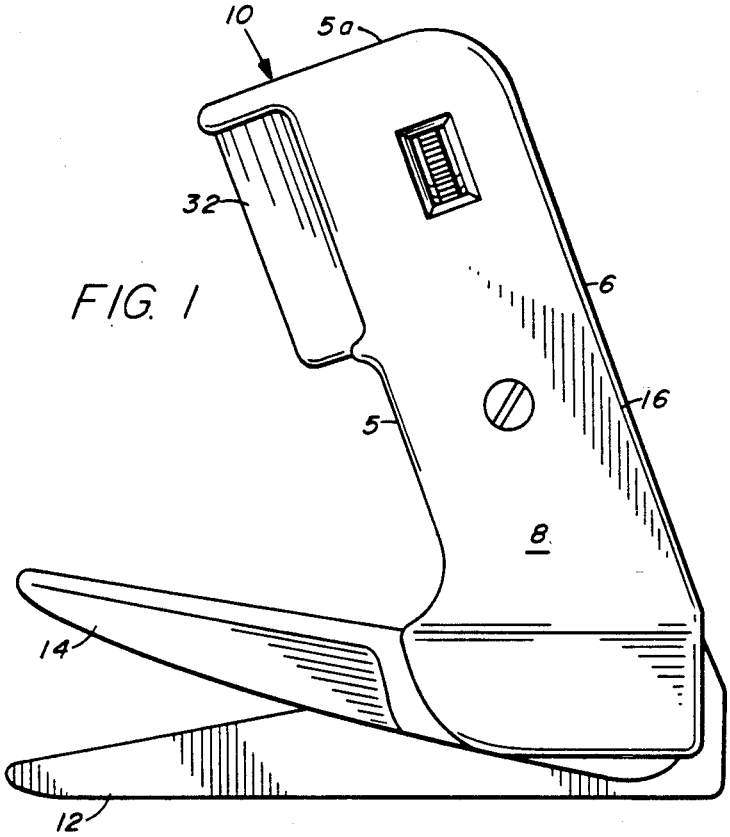
FIG. 1 is a side elevational view of the trigger actuated scissors of the present invention.
Figure 2:
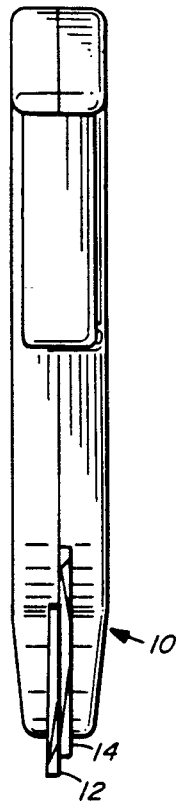
FIG. 2 is a front elevational view of the scissors shown in FIG. 1.
Figure 3:
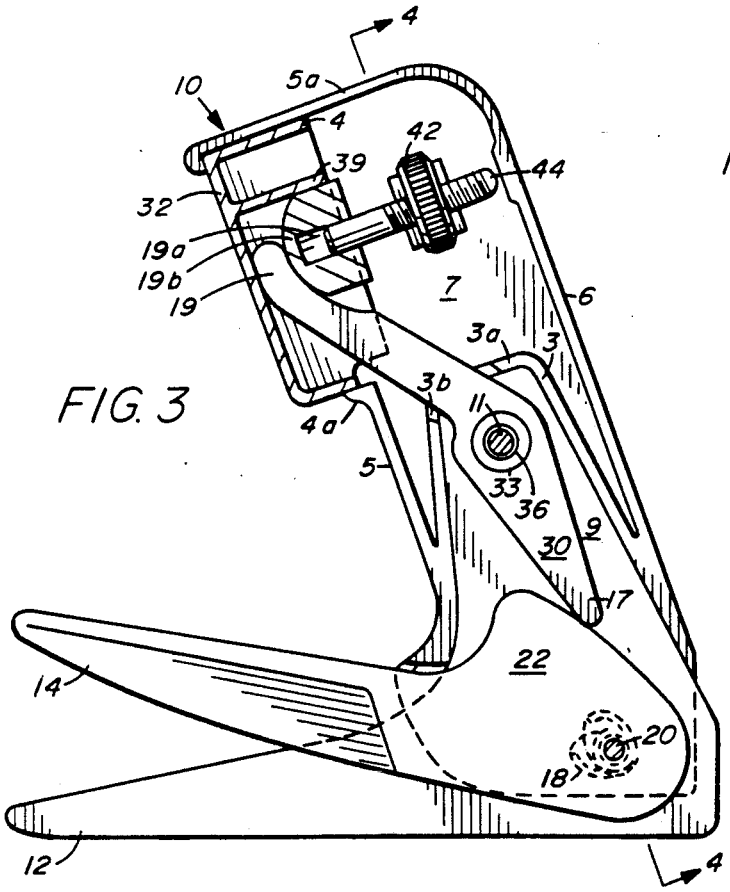
FIG. 3 is a cross-sectional view in side elevation of the scissors of FIG. 1.

The preferred trigger actuated scissors 10 are shown in FIGS. 1, 2, 3, and 4. Scissors 10 include a pair of lower and upper scissor blades 12, 14, respectively, pivotal with respect to each other. A handle 16 is mounted to lower or fixed scissor blade 12 such that an acute angle is formed between handle 16 and blade 12, and handle 16 extends transversely to the pivot axis of the blades, which is at a pivot point 20. A trigger mechanism 32 disposed on handle 16 is moved substantially transversely to the axis of the handle to pivot the blades and effect cutting action.

The handle 16 is attached to a plate 9, which is integral with blade 12 Plate 9 extends at substantially the same acute angle transverse to the pivot axis of blade 12 as does handle 16.

Handle 16 has two sides, 7, 8, and two substantially parallel edge sections, 5, 6, respectively located at the front and rear edge of the handle. Edge section 5 is shorter than edge section 6. Handle 16 also has an edge section 5*a* at its upper edge which is substantially perpendicular to edge sections 5 and 6.

A slot 4 extends into handle 16 in the same direction as edge section 5*a*, from the area just below the upper end of edge section 5. The upper and lower sides of slot 4 are defined by the inner side of edge section 5*a* and a boss 4*a*, respectively. Boss 4*a* extends parallel to edge section 5*a*. A trigger mechanism 32 is slidably disposed in slot 4.

An additional boss 3 also extends between sides 7 and 8. Boss 3 has two side portions which extend from near the lower portion of handle 16 and upwardly and inwardly and a mid-section 3*a*, which is parallel to edge section 5*a*. Mid-section 3*a* extends over a portion of the distance between the two side portions of boss 3, and is disposed near the center portion of handle 16.

Boss 3 is configured so that its inner perimeter mates with the outer perimeter of plate 9. Boss 3 prevents plate 9, and therefore bottom blade 12, from moving back and forth with respect to handle 16. An opening 3*b* is located in the front portion of mid-section 3*a* and also extends to the upper portion of the front section of boss 3.

Figure 4:
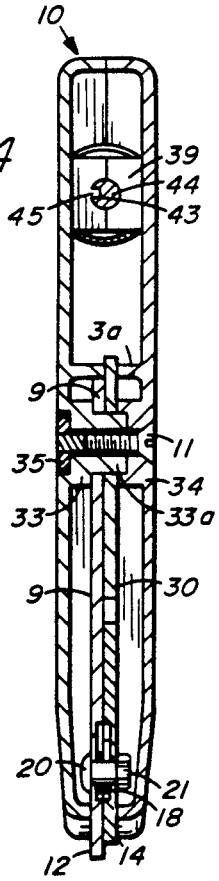
FIG. 4 is a cross-sectional view in front elevation of the scissors shown in FIG. 3, taken along the lines 3—3.
Figure 5:
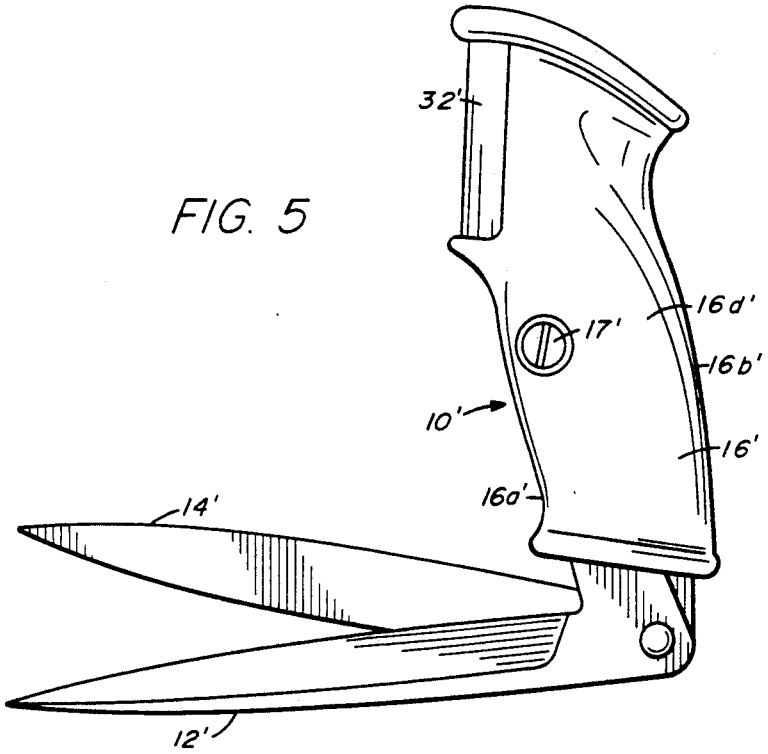
FIG. 5 is a side elevational view of a first alternate embodiment of the trigger actuated scissors of the invention.
Figure 6:
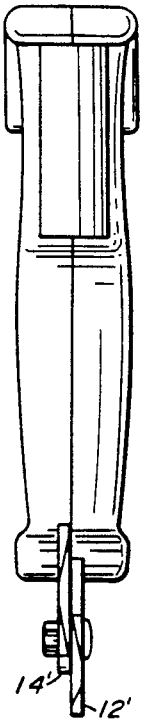
FIG. 6 is a front elevational view of the device of FIG. 5.
Figure 7:
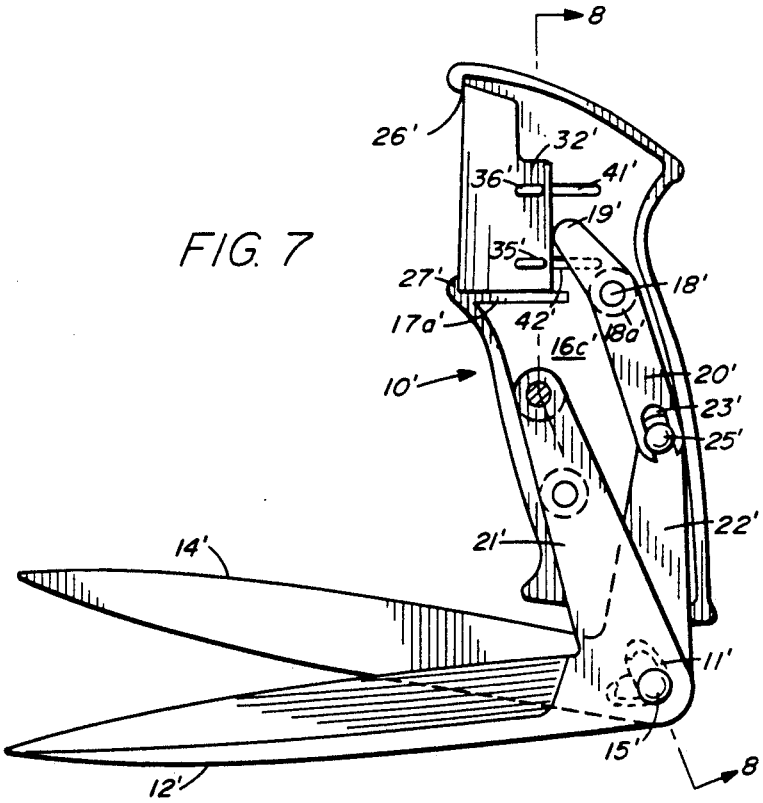
FIG. 7 is a sectional view of the device shown in FIG. 5.
Figure 8:
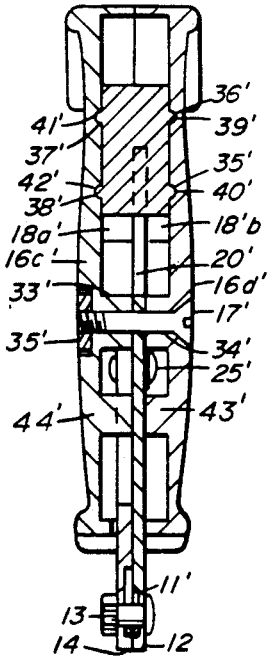
FIG. 8 is a sectional view, taken along the lines 8—8, of the device shown in FIG. 7.

To prevent plate 9 from moving from side 7 towards side 8 within handle 16, bosses 33, 34, respectively, are mounted to the inside wall of each side 7, 8 of handle 16, as best seen in FIG. 4. Bosses 33, 34, are cylindrical in shape. Boss 33 has a section 33*a* of decreased outside diameter near one end, and section 33*a* fits within a hole in plate 9 and a hole in a lever 30. A screw 11 extends from the outer portion of side 8, into boss 34, through the holes in lever 30 and plate 9 and into boss 33, which has a nut 35 at the end thereof.

Lever 30 is pivotally mounted at screw 11 to handle 16 and plate 9. The lower end 17 of lever 30 engages the upper edge of a cam 22 which extends from the upper edge of moving blade 14. The upper end 19 of lever 30 engages the inner side of trigger mechanism 32. Accordingly, screw 11 functions to hold handle 16 to plate 9, to hold the two sides 7, 8 of handle 16 together, and serves as the pivot point for lever 30.

Scissor blades 12, 14, are pivotally mounted to each other at a pivot point 20, for example, by running a bolt or rivet 21 through both blades. A spring 18 encircles bolt or rivet 21 and the ends of the spring 18 extend radially outwardly from the spring. Each end engages an end surface of a slot provided on the inside surface of each of the blades 12, 14, in order to bias the blades to an open position.

A bolt 44 extends inside handle 16 from near the inner edge of edge section 6 and into a hole 19*a* in a guide 19*b*. Guide 19*b* is attached to a boss 39, which is part of trigger mechanism 32. Boss 39 is disposed adjacent the upper surface of guide 19*b* and is affixed thereto, for example, with glue or a suitable adhesive.

When trigger mechanism 32 is depressed, it slides rearwardly along slot 4 and moves lever 30 until bolt 44 contacts the end of hole 19*a*. Further inward motion of trigger mechanism 32 is arrested at such point.

Bolt 44 includes an adjustment knob 42, which is in effect a female fastener engaging the outer threads of bolt 44. Rotating adjustment knob 42 causes bolt 44 to move either inwardly or outwardly with respect to hole 19*a*. A notch 43 in bolt 44 fits onto an extension 45 in boss 39 to prevent bolt 44 from rotating with knob 42, when knob 42 is rotated. Moving bolt 44 further inwardly with respect to hole 19*a* restricts inward travel of trigger mechanism 32 and, therefore, the degree to which the blades 12, 14 can be closed. Moving bolt 44 in the opposite direction has the opposite effect.

To cut an object with scissors 10, it is first positioned between blades 12 and 14. Trigger mechanism 32 is depressed by the operator to pivot lever 20 and the blades 12, 14, thereby closing the blades. The opening 3*b* in boss 3 is provided to allow lever 30 to pivot within handle 16 to the limits of opening 3*b*. The closing of the blades cuts the material.

Once the cut is initiated, with the adjustment bolt properly set, the trigger mechanism 32 can be depressed to the limit of travel, and scissors 10 may be pushed through the material without cyclical actuation of trigger mechanism 32, and without opening and closing the blades. However, to cut stronger or thicker fabrics, trigger mechanism 32 may have to be repeatedly depressed and released to effect cutting.

Referring to FIGS. 5 through 8, another embodiment of the invention, a trigger actuated scissors 10', is shown. Scissors 10' include a pair of lower and upper scissor blades 12', 14', respectively, pivotally mounted with respect to each other at a pivot point 15'. A protuberance 21' extends from lower or fixed blade 12' transversely to the pivot axis of the blades and at an acute angle with respect thereto. A handle 16', having a front edge 16*a'*, a rear edge 16*b'*, and sides 16*c'*, 16*d'*, is mounted to protuberance 21' and extends in the same direction as protuberance 21'. A trigger mechanism 32' moves substantially transversely to the axis of handle 16' to effect cutting.

To prevent protuberance 21' from moving side to side within handle 16', bosses 33', 34', respectively, are mounted to the inside walls 16*c'*, 16*d'*, similarly to the manner in which bosses 33, 34 prevent plate 9 from moving within handle 16. Bosses 33', 34', have the same cylindrical shape as bosses 33, 34.

A screw 17' passes from the outside of side 16*d'*, into boss 34', extends through the hole in protuberance 21', passes into boss 33', and is threaded to a nut 35'. Accordingly, screw 17' functions to hold handle 16' to protuberance 21' and also to hold the two sides 16*c'*, 16*d'* of handle 16' together.

Two bosses 43', 44', respectively, are disposed on either side of protuberance 21', approximately in its mid-portion. Boss 43' is attached to side 16*d'*, and boss 44' is attached to side 16*c'*, and they help to stabilize protuberance 21' within handle 16'.

A lever 20' is pivotally mounted inside handle 16' by a bolt 18'. Bolt 18' extends through both sides 16*c'*, 16*d'* of handle 16'. Bolt 18' extends through a bore in the center of bosses 18*a'*, 18*b'*, and through a hole in lever 20'. Bosses 18*a'*, 18*b'* are affixed to sides 16*c'*, 16*d'*, respectively, and positioned on either side of lever 20'. Bosses 18*a'*, 18*b'* aid in holding the lever 20' in the center of handle 16'.

A cam 22' extends from upper or movable blade 14' and into handle 16'. Lever 20' has an opening 23' in its lower end, which preferably tapers to a widened area towards the mouth of the opening. A pin 25' which is affixed to cam 22' slidably mates with opening 23'.

The upper end 19' of lever 20' engages the inner side of trigger mechanism 32'. Trigger mechanism 32' slides along slot 17' in the upper portion of handle 16'. Slot 17' is preferably formed by an upper and lower boss, 26', 27', respectively, both of which extend from side 16*c'* towards side 16*d'*. To further stabilize movement of trigger mechanism 32', a plurality of pins, e.g., pins 35', 36', 37', 38', are disposed on either side of trigger mechanism 32'. The pins 35', 36', 37', 38' slidably engage one or more slots in the sides of the handle 16'. Accordingly, pins 35', 36' respectively engage slots 39', 40' on the inside of side 16*d'*, and pins 37', 38' respectively engage slots 41', 42' on the inside of side 16*c'*.

Scissor blades 12', 14', are pivotally mounted at a pivot point 15', for example, by running a bolt or rivet 13' through apertures in both blades. A spring 11', disposed in a slot provided on the inside surface of each blade 12', 14', encircles the bolt or rivet 13', and the ends of the spring 11' extend radially outwardly. Each end of the spring 11' engages an end surface of the slots in the blades 12', 14', in order to bias the blades to the open position.

It should be noted that as an optional feature, scissors 10' could have an adjustment mechanism, similar to adjustment mechanism 42 of scissors 10. The optional adjustment mechanism would be used to limit the inward travel of trigger mechanism 32', and the degree to which blades 12', 14' close when the trigger mechanism 32' is depressed. Such an adjustment mechanism makes the scissors 10' better suited for use as a ripping tool, i.e., a tool for cutting material without the need for pivoting the blades.

The operation of scissors 10' will now be described. The object to be cut is positioned between blades 12', 14'. Trigger mechanism 32' is depressed by the operator, causing lever 20' to pivot around bolt 18'. The lower end of lever 20' moves towards the front edge 16*a'* of handle 16'. Due to the engagement between pin 25' and opening 23', cam 22' is also moved towards front side 16*a'*. As lever 20' pivots, pin 25' slides towards the upper end of slot 23'. At the limit of inward travel of trigger mechanism 32', when the lower end of lever 20' is as close as it gets to edge 16*a'*, pin 25' is at the upper limit of its travel in slot 23'. Because cam 22' is integral with blade 14', the movement of cam 22' towards front side 16*a'* causes blade 14' to pivot towards blade 12', thereby cutting the object which is between the blades.

Figure 9:
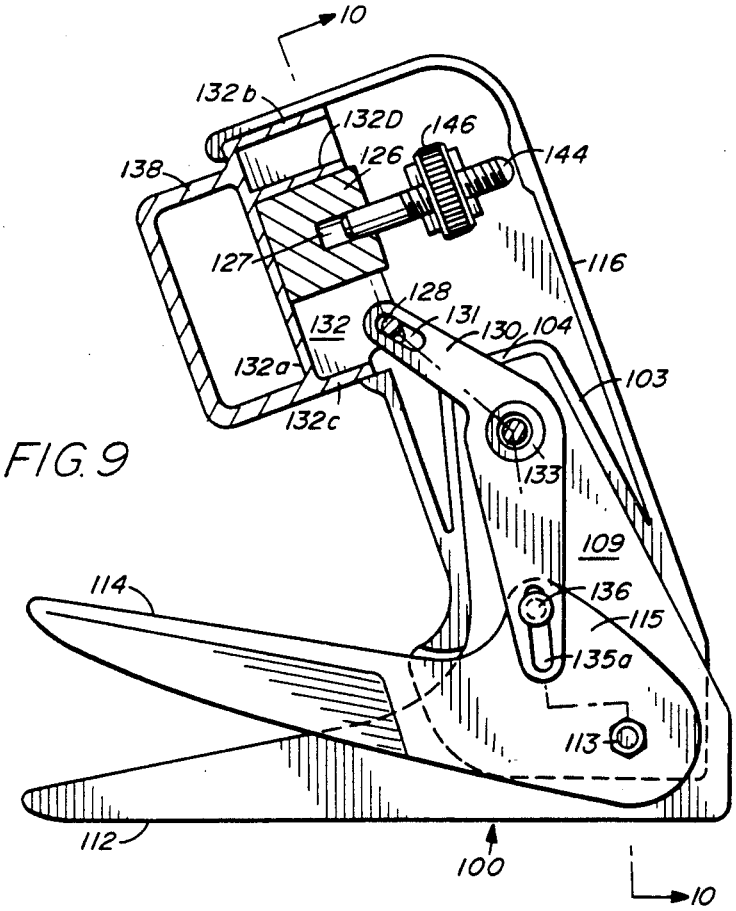
FIG. 9 is a side elevational sectional view of a second alternate embodiment of the trigger actuated scissors of the invention.
Figure 10:
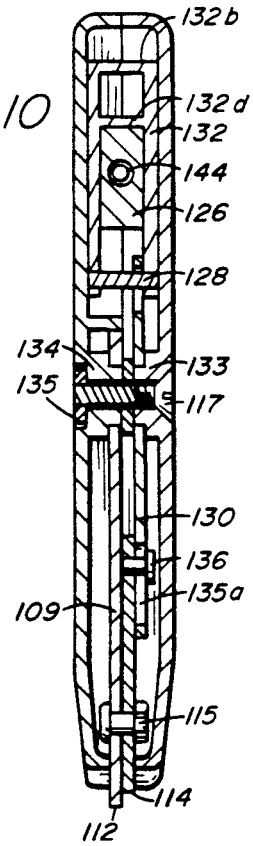
FIG. 10 is a sectional view of the device of FIG. 9, taken along the lines 10—10.

Another alternate embodiment of the invention is trigger actuated device 100 shown in FIGS. 9 and 10. The various parts of device 100, and their functions, are essentially analogous to the parts of device 10. Device 100 has upper and lower blades 114, 112, respectively, pivotal with respect to each other. A plate 109 extends from lower blade 112 at an acute angle to the axis of the blade, transverse to the pivot axis of the blades. Handle 116 is affixed to plate 109 with the aid of a boss 103, which surrounds and holds the majority of the perimeter of plate 109 in a like manner to that in which boss 3 surrounds and holds blade 14. Handle 116 extends at the same acute angle as plate 109. Boss 103 has an opening 104 in its upper section and in its upper front section through which a lever 130 can pass.

Lever 130 is pivotally mounted in the central portion of handle 116. Bosses 133, 134 are attached to each inside wall of handle 116. Boss 134 has a portion of decreased diameter which fits into a hole in plate 109. Boss 133 is disposed on the opposite side of lever 130, and has a decreased diameter portion which fits into a hole in lever 130. A screw 117 passes from the outside of one wall of handle 116, into boss 133, through lever 130 and plate 109, into boss 134, and threads into a nut 135. Bosses 133, 134 prevent lever 130 from moving from side to side within handle 116.

The upper end of lever 130 has a slot 131 which slidably engages a pin 128 disposed between the outer walls of trigger mechanism 132, so as to provide a lost motion connection between the trigger mechanism and the lever. The lower end of lever 130 has a slot 135 which slidably engages a pin 136 disposed on a cam 115 on upper blade 114, thereby also providing a lost motion connection between the lever to the upper blade.

Trigger mechanism 132 has a wall 132*a* at the front and two walls 132*b*, 132*c* at the upper and lower sides, respectively. A wall 132*d* is disposed between walls 132*b*, 132*c*. A boss 126 having a hole 127 extending from its rear side is attached to the lower side of wall 132*d*.

An adjustment screw 144 extends into hole 127. Adjustment screw 144 can be moved forwardly and rearwardly by rotating knob 146. Such adjustment allows one to adjust the travel of trigger mechanism 132 in the same manner and for the same purpose, i.e., for using scissors 100 as a ripping tool, as adjusting of the travel of trigger mechanism 32 on scissors 10.

The trigger mechanism 132 has a forwardly extending fingerhold 138. Fingerhold 138 is a U-shaped flange which is designed to fit around an operator's fingers when the operator's hand is in a position to manipulate the trigger mechanism 132.

Blades 112, 114, are pivotally attached at a pivot point 113. There is no spring or any other biasing mechanism to bias blades 112, 114 to the open position.

Scissors 100 are operated as follows. The object to be cut is positioned between blades 112, 114, and the operator positions his fingers in front of trigger mechanism 132 and behind fingerhold 138. The trigger mechanism 132 is then pushed inwardly, pivoting lever 130 and pushing pin 128 towards the lower end of slot 131, and pin 136 towards the upper end of slot 135. Accordingly, this causes upper blade 114 to pivot, and blades 112, 114 are closed together, cutting the object between them.

Because blades 112, 114 are not biased to the open position, the operator must open them by pulling outwardly on fingerhold 138. This action, in turn, pulls out trigger mechanism 132, moves pin 128 towards the upper end of slot 131, and moves pin 136 towards the lower end of slot 135. As a result, blade 114 is pivoted away from blade 112.

Figure 11:
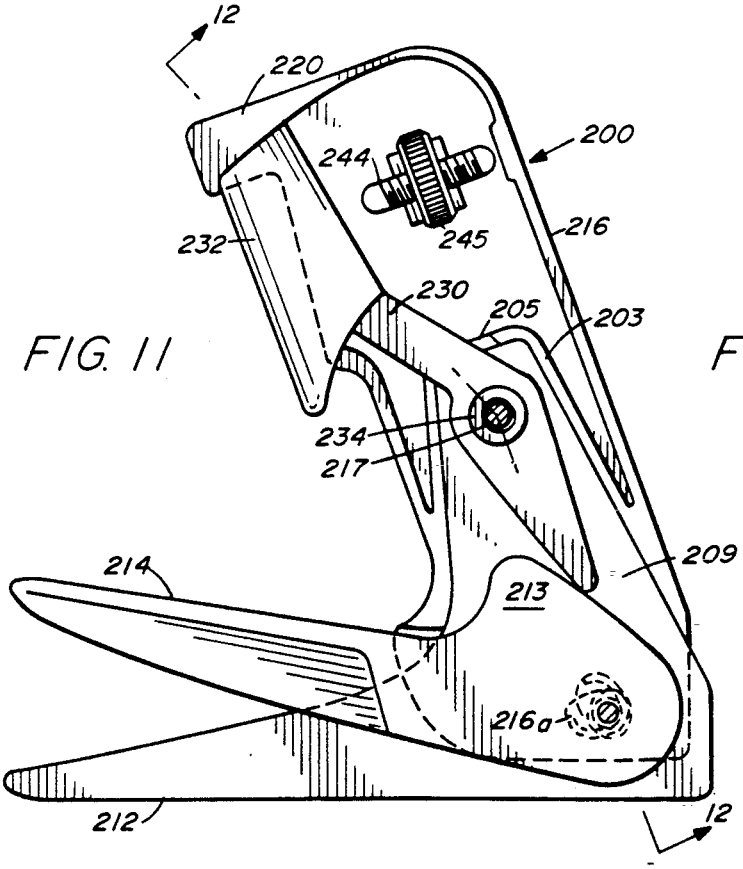
FIG. 11 is a side elevational sectional view of a third alternate embodiment of the trigger actuated scissors of the invention.
Figure 12:
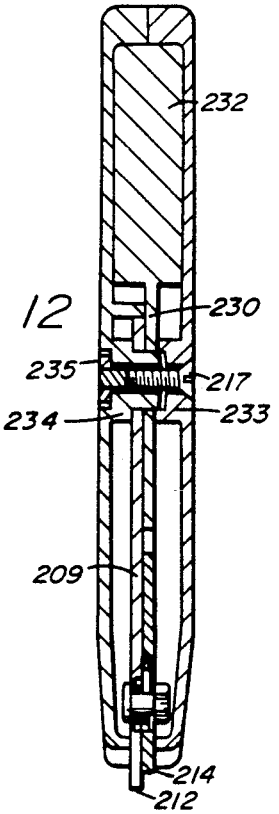
FIG. 12 is a sectional view of the device of FIG. 11, taken along the lines 12—12.

Another alternate embodiment of the invention is trigger actuated device 200 shown in FIGS. 11 and 12. The various parts of scissor device 200, and their functions, are essentially analogous to the parts of scissor device 10, shown in FIGS. 1 to 4. Scissor device 200 has pivotally attached upper and lower blades 214, 212, respectively, with a spring 216*a* biasing the blades to an open position. A plate 209 extends at an acute angle with respect to the axis of the lower blade 212 and transverse to the pivot axis of the blades, and is attached to a handle 216, which extends in the same direction. Plate 209 has its sides surrounded by a boss 203, which extends around the perimeter of plate 209 and is open on a portion 205 of the upper part, and the upper part of the front side, in the same manner as boss 3 of device 10.

A lever 230 is pivotally mounted within handle 216. Bosses 233, 234 are attached to each side of handle 216. Boss 234 has a section of reduced outside diameter which passes through a hole in plate 209 and a hole in lever 230. A screw 217 passes through the outer side of handle 216, into boss 233, into boss 234, and threads into a nut 235. Screw 217 holds handle 216 to plate 209.

The lower end of lever 230 engages a cam 213 extending from the upper blade 214. The upper end of lever 230 is affixed to the lower end of a trigger mechanism 232. Trigger mechanism 232 slides within handle 216 on an arcuate pathway. The upper side of this arcuate pathway is defined by the inside surface of an upper wall 220 of handle 216, which the upper side of trigger mechanism 232 slidably engages.

An adjustment bolt 244 with an adjustment knob 245 operates in the same manner and serves the same function as adjustment bolt 44 of device 10. Adjustment bolt 244 can be adjusted to contact the rear side of trigger mechanism 232 and limit the inward travel of trigger mechanism 232, which in turn limits the pivoting of lever 230 and the degree of closure of blades 214, 212.

In operation, an object to be cut is placed between blades 212, 214. Trigger mechanism 232 is depressed by an operator, causing it to slide inwardly with respect to handle 216 along the arcuate path described above. This in turn causes pivoting of lever 230, closing of blades 212, 214, and cutting of the object. The adjustment bolt 244 can also be set so that in a like manner to that described above for scissors 10, trigger mechanism 232 can be depressed, and scissors 200 can be used as a ripping tool.

It should be understood that the foregoing terms, expressions and embodiments are exemplary only and not limiting, and that the scope of protection is limited only by the claims which follow and includes all equivalents of the subject matter of the claims.

What is claimed is:

1. A scissor device, comprising:

a lower blade and an upper blade each having a longitudinal axis pivotal with respect to each other along a pivot axis and having a pivot point disposed substantially at one end of said blades;

a handle fixed with respect to the lower blade and extending over said blades and transversely with respect to the pivot axis of the blades and at an acute angle with respect to the longitudinal axis of the lower blade;

a trigger means on said handle for actuating pivoting of said blades; and a lever pivotably mounted within said handle for pivoting said upper blade upon actuation of said trigger means, said lever having one end engaging said trigger and another end engaging a protuberance on said upper blade, said protuberance being located forwardly from said pivot point and acting as a cam, whereby actuation of said trigger causes said lever to pivot in one direction and engagement of said cam by said lever causes said upper blade to pivot in an opposite direction.

2. The scissor device of claim 1 wherein the protuberance includes a cam surface.

3. The scissor device of claim 2 wherein the lever is affixed to the trigger means.

4. The scissor device of claim 1 further including means for biasing the blades to an open position.

5. The scissor device of claim 1 wherein a spring disposed at the pivot point biases the blades to an open position.

6. The scissor device of claim 1 further including means for limiting the travel of the trigger means with respect to the handle whereby the closure of the blades is also limited.

7. A scissor device, comprising:

a lower substantially fixed blade and an upper movable blade each having a longitudinal axis, said upper movable blade being pivotal with respect to the lower blade along a pivot axis;

a handle extending over said blades from the fixed blade at an acute angle with respect to the longitudinal axis of the fixed blade and transverse to the pivot axis of the blades;

a lever pivotally affixed to the handle and engaging a trigger and a portion of the upper blade such that pivoting of the lever in one direction pivots the upper blade in an opposite direction;

the trigger slidably disposed in the handle whereby actuation of the trigger pivots the lever.

8. The scissor device of claim 7 further including a spring disposed at the pivot point for biasing the blades to an open position.

9. The scissor device of claim 7 wherein the trigger further includes a finger hold for the operator.

10. The scissor device of claim 7 wherein the lever is attached to the trigger and the trigger slides on an arcuate path with respect to the handle.

11. The scissor device of claim 7 further including a means for affixing the handle to the lower blade.

12. The scissor device of claim 11 wherein said means for affixing further includes a pivot point for the lever.

13. The scissor device of claim 11 wherein said means for affixing includes a screw which passes through the handle and through a portion of the lower blade which extends into the handle.

14. The scissor device of claim 11 wherein the means for affixing further includes a boss which surrounds a part of the lower blade which extends into the handle.

15. A scissor device, comprising:

a lower substantially fixed blade and an upper movable blade each having a longitudinal axis, said upper movable blade being pivotal with respect to the lower blade along a pivot axis;

a handle extending over said blades from the fixed blade at an acute angle with respect to the longitudinal axis of the fixed blade and transverse to the pivot axis of the blades;

a lever pivotally affixed to the handle and engaging a trigger and a portion of the upper blade such that pivoting of the lever pivots the upper blade;

the trigger slidably disposed in the handle whereby actuation of the trigger pivots the lever;

the lever and the upper blade being connected through a connector allowing said lever to travel a given distance before said upper blade moves due to said connection.

16. A scissor device, comprising:

a lower substantially fixed blade and an upper movable blade each having a longitudinal axis, said upper movable blade being pivotal with respect to the lower blade along a pivot axis;

a handle extending over said blades from the fixed blade at an acute angle with respect to the longitudinal axis of the fixed blade and transverse to the pivot axis of the blades;

a lever pivotally affixed to the handle and engaging a trigger and a portion of the upper blade such that pivoting of the lever pivots the upper blade;

the trigger slidably disposed in the handle whereby actuation of the trigger pivots the lever;

the lever and the trigger mechanism being connected through a connector allowing said lever to travel a given distance before said upper blade moves due to said connector.

17. A scissor device, comprising:

a lower substantially fixed blade and an upper movable blade each having a longitudinal axis, said upper movable blade being pivotal with respect to the lower blade along a pivot axis;

a handle extending from the fixed blade at an acute angle with respect to the longitudinal axis of the fixed blade and transverse to the pivot axis of the blades;

a lever pivotally affixed to the handle and engaging a trigger and a portion of the upper blade such that pivoting of the lever pivots the upper blade;

the trigger slidably disposed in the handle whereby actuation of the trigger pivots the lever; and an adjustable bolt disposed in the handle whereby adjustment of the bolt limits the travel of the trigger and the degree to which the blades close.

18. A scissor device, comprising:

a lower substantially fixed blade and an upper movable blade each having a longitudinal axis, said upper movable blade being pivotal with respect to the lower blade along a pivot axis;

a handle extending from the fixed blade at an acute angle with respect to the longitudinal axis of the fixed blade and transverse to the pivot axis of the blades;

a lever pivotally affixed to the handle and engaging a trigger and a portion of the upper blade such that pivoting of the lever pivots the upper blade;

the trigger slidably disposed in the handle whereby actuation of the trigger pivots the lever;

a means for affixing the handle to the lower blade; and the means for affixing further including a boss disposed on either side of the lever to prevent side to side movement of the lever.

19. A scissor device, comprising:

a lower substantially fixed blade and an upper movable blade each having a longitudinal axis, said upper movable blade being pivotal with respect to the movable blade along a pivot axis;

a handle extending over said blades from the fixed blade substantially transverse to the pivot axis of the blades, said handle forming an acute angle with the fixed blade;

a trigger mechanism disposed in the handle and slidable with respect to the handle in the direction substantially perpendicular to the axis of the handle;

said blades pivoting in a plane common to the direction of movement of the trigger mechanism;

linkage extending between the trigger mechanism and upper blade whereby the sliding of the trigger mechanism causes pivoting of the linkage, said linkage being connected to said upper blade such that both rotational and translational motion of the linkage relative to the upper blade occur when the trigger is actuated whereby said linkage and said upper blade pivot in opposite directions.

20. The scissor device of claim 19 wherein the linkage includes a lever movable with respect to the trigger mechanism and the upper blade.

21. The scissor device of claim 19 further including means for biasing the blades to an open position.

22. The scissor device of claim 19 wherein a spring disposed at the pivot point biases the blades to an open position.

23. The scissor device of claim 19 further including means for limiting the travel of the trigger mechanism with respect to the handle and the closure of the blades.

24. The scissor device of claim 19 wherein the handle extends at an acute angle with respect to the axis of the blades.

25. The scissor device of claim 19 wherein the linkage engages the upper blade forwardly of the pivot point of the blades.

26. The scissor device of claim 19 wherein the linkage includes a lever affixed to the trigger mechanism and the trigger mechanism slides on an arcuate path with respect to the handle.

27. The scissor device of claim 26 wherein the trigger mechanism further includes a fingerhold for the operator.

28. A scissor device, comprising:

a lower substantially fixed blade and an upper movable blade each having a longitudinal axis, said upper movable blade being pivotal with respect to the movable blade along a pivot axis;

a handle extending over said blades from the fixed blade substantially transverse to the pivot axis of the blades, said handle forming an acute angle with the fixed blade;

a trigger mechanism disposed in the handle and slidable with respect to the handle in the direction substantially perpendicular to the axis of the handle;

said blades pivoting in a plane common to the direction of movement of the trigger mechanism;

linkage extending between the trigger mechanism and upper blade whereby the sliding of the trigger mechanism causes pivoting of the upper blade;

the linkage and the upper blade being connected through a connector allowing said lever to travel a given distance before upper blade moves due to said connector.

29. A scissor device, comprising:

a lower substantially fixed blade and an upper movable blade each having a longitudinal axis, said upper movable blade being pivotal with respect to the movable blade along a pivot axis;

a handle extending over said blades from the fixed blade substantially transverse to the pivot axis of the blades, said handle forming an acute angle with the fixed blade;

a trigger mechanism disposed in the handle and slidable with respect to the handle in the direction substantially perpendicular to the axis of the handle;

said blades pivoting in a plane common to the direction of movement of the trigger mechanism;

linkage extending between the trigger mechanism and upper blade whereby the sliding of the trigger mechanism causes pivoting of the upper blade;

the linkage and the trigger mechanism being connected through a connector allowing said lever to travel a given distance before said upper blade moves due to said connector.

* * * * *